United States Patent [19]

Schultz et al.

[11] Patent Number: 4,620,309

[45] Date of Patent: Oct. 28, 1986

[54] ELECTRIC FURNACE CONSTRUCTION

[75] Inventors: Stephen J. Schultz; John F. Huebner; Duane E. Wiedor; Dennis S. Pribish, all of Pittsburgh, Pa.

[73] Assignee: PPG Industries, Inc., Pittsburgh, Pa.

[21] Appl. No.: 717,939

[22] Filed: Mar. 29, 1985

[51] Int. Cl.[4] ..... F27D 11/02

[52] U.S. Cl. ..... 373/128; 373/137

[58] Field of Search ..... 373/128, 130, 137

[56] References Cited

U.S. PATENT DOCUMENTS

| | | | |
|---|---|---|---|
| 1,477,347 | 12/1923 | Hands | 373/130 |
| 3,892,396 | 7/1975 | Monaghan | 266/43 |
| 4,088,825 | 5/1978 | Carr | 13/25 |
| 4,154,975 | 5/1979 | Sauder | 13/25 |

*Primary Examiner*—Roy N. Envall, Jr.

*Attorney, Agent, or Firm*—Andrew C. Siminerio

[57] ABSTRACT

A furnace with the end portions of a heater supporting anchor rod embedded in the rigid sidewall insulation of the furnace. The anchor rods do not deflect under the weight of the heaters and the entire weight of the anchor rods and heaters is supported by the sidewall insulation.

12 Claims, 3 Drawing Figures

ELECTRIC FURNACE CONSTRUCTION

BACKGROUND OF THE INVENTION

1. Field of the Invention

This invention relates to the construction of an electric furnace and more particularly to a novel apparatus and method for supporting electric heating elements in a furnace.

2. Technical Considerations

Many industrial processes that require high temperature environments use electric furnaces. Typical electric furnace design includes an outer structural casing with an internally insulated cavity. Electric heating elements are suspended from hangers within the furnace. When solid insulation, such as firebrick, can be used to insulate the furnace, the hangers are generally secured directly to the insulation. When a lightweight insulation is required, low inertia ceramic fiber insulation has been used. This insulation can be installed in module-type packages or in batts and attached to the furnace wall in a variety of ways, such as impaling the insulation over a stud or some other well-known technique. To support the electric heating elements, the hangers either penetrate the insulation and are secured to the outer casing, or the hangers are secured to short rods embedded within the insulation. When the hangers are directly secured to the furnace casing, the furnace walls can develop hotspots at these connections. In addition, when the short embedded anchor rods are used, it has been found that over a period of time, the weight of the rods and the supported electrical heating elements caused the fiber insulation to become packed, that is compressed. As a result, the relative positions of the hangers and electric heating elements can change within the furnace.

It would be advantageous to have an arrangement for lightweight furnace construction whereby the electric heating elements could be positioned within a furnace and maintained in their original position without affecting the insulating layers.

PATENTS OF INTEREST

U.S. Pat. No. 4,088,825 to Carr teaches a wall construction for an electric furnace. The electrical heating elements are supported by hangers secured to an elongated plate that is sandwiched between adjacent insulating batts. The plate receives an elongated pin which serves to engage at least one of the adjacent insulating batts in order to hold the entire support assembly in place.

U.S. Pat. No. 4,154,975 to Sauder teaches the construction of an insulation module that is attachable to an electric furnace wall. Elongated anchor rods are embedded completely within the insulation of each module and hook members are used to support the electrical heating elements from the anchor rods. Each insulation module supports the weight of the anchor rod and the weight of the heating elements.

SUMMARY OF THE INVENTION

The present invention provides a furnace having insulated opposing sidewalls and an insulated roof. An anchor rod spans the width of the furnace and passes through the roof insulation with each end of the rod being embedded within the structurally rigid insulation at each of the sidewalls. Heating elements are supported from the anchor rod.

The present invention further provides that the anchor rods remain essentially undeflected when supporting the heating elements and that the structurally rigid sidewall insulation supports the weight of the anchor rods and heating elements when the ends of the anchor rod are embedded therein. The anchor rod is a ceramic material and the ends of the anchor rod are embedded in the structurally rigid insulation such that they are in spaced relation from the side walls.

The heating elements are supported from the anchor rods by S-shaped hooks whose one end are removably engaged with the anchor rod and their opposite end is removably engaged with the heating elements.

The present invention also provides a method of supporting a heating element in a furnace by spanning the width of the furnace with a structurally rigid anchor rod, engaging one end of a heating element support member with the rod, and the other end of the heating element support member with the heating element, and supporting the anchor rods such that the weight of the rod and the heating elements is supported at end portions of the rod.

DETAILED DESCRIPTION OF THE INVENTION

Figure 1:
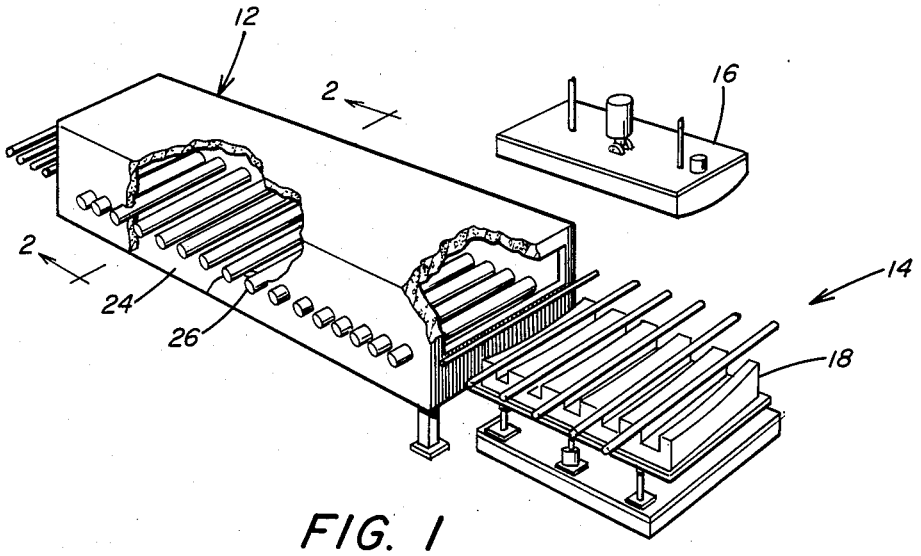
FIG. 1 is a perspective view of an electrical furnace used in conjunction with a glass sheet shaping apparatus.

Electric furnaces are used in many applications. Although not limited by the present invention, FIG. 1 shows a furnace 12 of the type used for heating glass sheets. The furnace 12 is aligned with a hot glass sheet forming station 14. The glass sheet passes through the furnace 12 where the temperature of the glass is raised to its deformation temperature. The glass sheet then continues to the shaping station 14 where it is shaped between upper mold 16 and lower mold 18. The glass sheet is then removed from the shaping station 14 and quenched in a manner well known in the art. Typical glass sheet forming and quenching is shown in U.S. Pat. No. 4,221,580 to Frank which is herein incorporated by reference.

Figure 2:
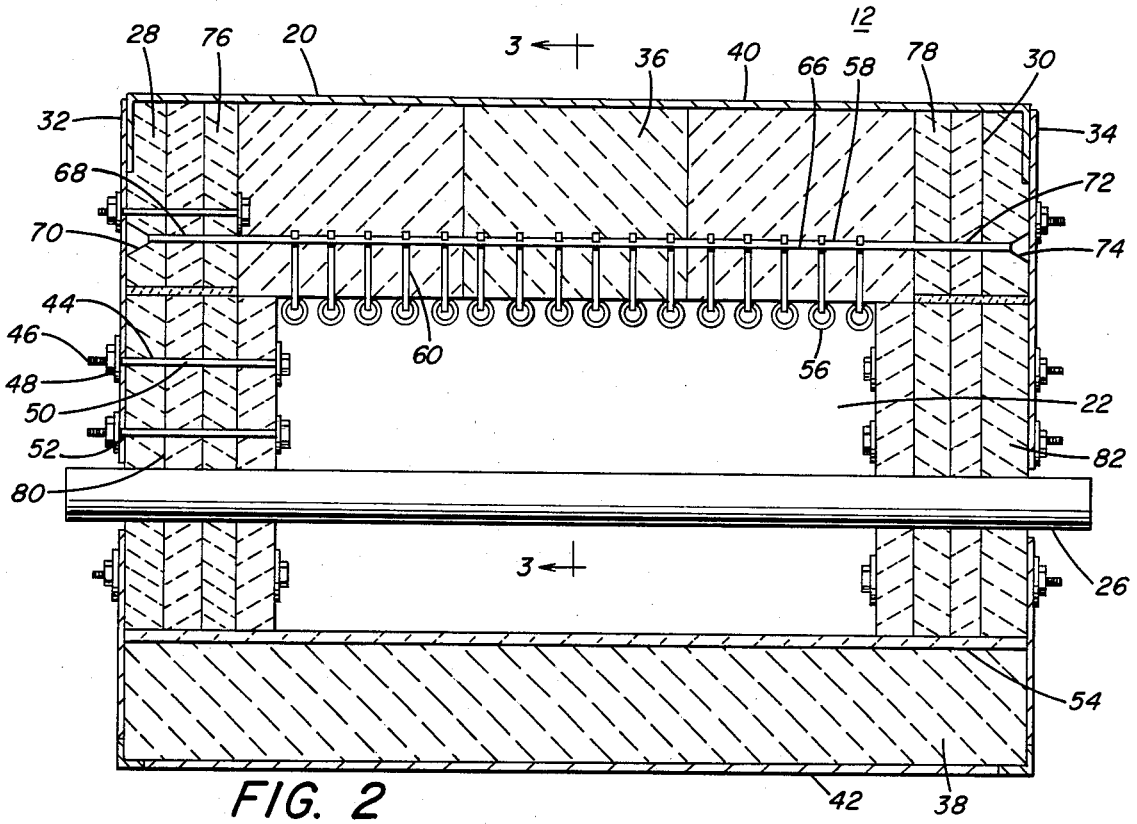
FIG. 2 is a cross-sectional view taken through lines 2—2 of FIG. 1.
Figure 3:
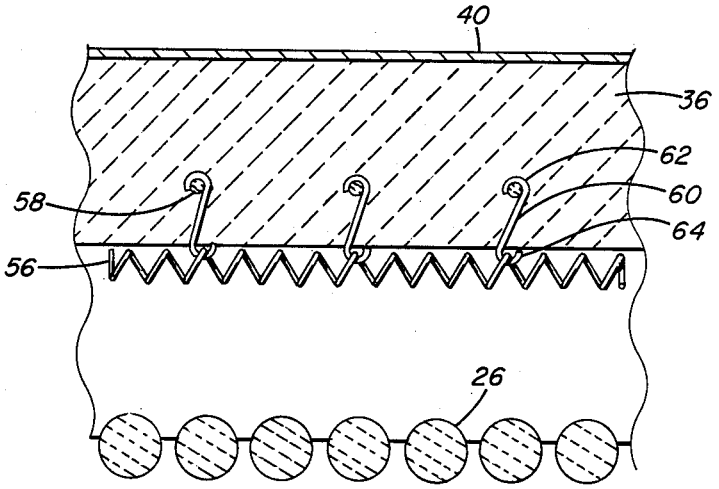
FIG. 3 is a cross-sectional view taken through lines 3—3 of FIG. 2.

FIGS. 2 and 3 detail the preferred embodiment of the present invention in more detail. The furnace 12 includes an outer casing 20, preferably made out of steel plate. The casing 20 defines a furnace cavity 22 through which the glass sheet passes during heating and provides a vehicle to which the furnace insulation is attached. Conveyor 24 transfers the glass sheet through the furnace cavity 22. In the preferred embodiment, the conveyor 24 includes a series of ceramic conveyor rolls 26 one of which is shown in FIG. 2, which traverse the furnace cavity 22 and extend outside the furnace casing 12 as clearly shown in FIG. 1. The rolls 26 are driven in unison in any convenient manner to convey the glass sheet through the furnace 12.

Insulation in the furnace 12 prevents heat loss and protects personnel operating in the vicinity of the furnace 12. In the practice of the invention, two basic types of insulation can be used. Dense insulation boards 28 and 30 are used to insulate furnace walls 32 and 34, respectively, and low inertia ceramic fiber insulation 36 and 38 is used to insulate the furnace roof 40 and floor 42, respectively.

The dense insulation boards 28 and 30 are generally available in predetermined board lengths and widths. The number of boards required will depend on the heating temperature characteristics of the furnace 12. The dense insulation boards 28 and 30 are preferably attached to the furnace walls by an assembly 44 which includes a bolt 46 and nut 48. Bolt portion 46 passes through a bore 50 in the dense board 28 and hole 52 of the wall 32 and preferably extends from the inside of the furnace cavity 22 outward so that any portion of the bolt 46 that extends past the nut 48 does not extend inwardly into the furnace 12. It should be noted that the dense insulation boards 28 and 30 can be attached to the furnace casing 20 by other methods well known in the art.

The fiber insulation 36 is secured to the roof 40 by adhesives, attachment to angle clips (not shown) welded to the roof 20, or in any other fashion well known in the art. The fiber insulation 38 is laid along the furnace floor 42 and covered with a more rigid insulating board 54. The board 54 protects the fiber insulation 38 from broken glass and makes it easier to remove any broken glass from the furnace 12.

Heat in the furnace is provided by plurality of electrical heating element 56 that are suspended below the fiber insulation 36. The heating elements are preferably of high electrical resistant wire and are coil shaped. The elements 56 generally extend in the longitudinal direction of the furnace so that if required, the temperature of the individual elements or groups of elements can be monitored and modified to create a temperature gradient in the transverse direction of the furnace 12.

The heating elements 56 are suspended below the fiber insulation 36 of the furnace roof 40 from a plurality of anchor rods 58 by hook members 60. The anchor rods 58 are preferably made of a high heat resistant ceramic material so that it can function within the furnace without deforming or degrading. A first end 62 of the hook member 60 removably engages the anchor rod 58 and a second end 64 removably engages the heating element 56. In assembling the furnace 12, the hook members 60 are either forced through the fiber insulation 36 to the anchor rod 58 or the fiber insulation 36 is cut to provide access to the rod 58. Although hook members 60 are shown to be S-shaped, in practice they can be of any configuration that can support the electric heating element 56 from the anchor rod 58.

Each of the anchor rods 58 passes through the fiber insulation 36 and spans the width of the furnace 12 with a single rod. During assembly of the furnace 12, a bore 66 can be drilled through the fiber insulation 36 for the anchor rod 58. As an alternative, the anchor rod 58 can simply be forced through the fiber insulation 36. End 68 of the anchor rod 58 is embedded in opening 70 of the dense insulation board 28 and end 72 is embedded in opening 74 of the dense insulation board 30. The anchor rod 58 is structurally rigid enough to support its own dead weight as well as the weight of the heating elements 56 and the hook members 60 that are suspended from it. This weight is transferred to the end portions 68 and 72, and in turn, to the dense insulation boards 28 and 30, respectively, which must be structurally rigid enough to support the load transfer by the end portions 68 and 72. As a result, there is little or no load on that portion of the fiber insulation 36 of furnace roof 40 between the heating elements 56 and the anchor rod 58 due to the load of the rod 58 and the heating elements 56 that would cause the fiber insulation 36 to become compressed and alter the position of the heating elements within the furnace cavity 22. If the width of the furnace 12 is too large, intermediate supports from the roof 20 can be used to prevent the anchor rod 58 from deflecting and thus packing the fiber insulation 36 and moving the heating elements 56 closer to the glass sheets being conveyed through the furnace 12.

Ends 68 and 72 of the anchor rod 58, are preferably spaced from the furnace wall 32 and 34.

This new furnace design insures a better alignment of the heating elements 56 and provides a stronger structure since a more rigid form of insulation is used along the side walls and the anchor rods 58 will not deflect appreciably downwardly within the fiber insulation 36 and cause it to become packed.

An electric furnace of the type described has been constructed. The outer casing 20 is constructed of 0.25 inch (0.635 cm) steel plate. The furnace is 48 inches (121.92 cm) wide with about 32 inches (81.28 cm) of clearance between opposing dense insulation boards 28 and 30. Each set of insulation boards 28 and 30 is divided into an upper section 76 and 78 and a lower section 80 and 82, respectively. Sections 76 and 78 include three 2 inch (5.08 cm) thick insulating boards marketed by Babcock and Wilcox under the trade name "KAOWOOL M BOARD." Lower sections 80 and 82 are constructed of three 2 inch (5.08 cm) "KAOWOOL M BOARDS" and one 2 inch (5.08 cm) thick super rigidized "KAOWOOL M BOARD." The super rigidized boards are positioned at the interior of the cavity and provide additional protection to the insulation against damage resulting from misaligned or broken glass. The fiber insulation 36 includes three 12 inch (30.48 cm) by 12 inch (30.48 cm) by 10 inch (25.4 cm) thick blocks of "PYRO-BLOC" thermal insulation modules available from Sauder Energy Systems, Inc. The anchor rods 58 are preferably 0.5 inch (1.27 cm) outer diameter by 0.25 inch (0.635 cm) inner diameter by 42 inch (106.68 cm) long continuous ceramic tubes, although solid ceramic rods could be used. The heater elements 56 are 0.875 inch (2.22 cm) inner diameter by 0.182 inch (0.462 cm) wire diameter heating coils. The hook members 60 are No. 11 gauge nichrome wire bent to shape when installed in the furnace 12. In order to maintain furnace efficiency, care should be taken to not embed the heating elements 56 into the fiber insulation 36.

It should be noted that since the hook member 60 are metal, the anchor rod 58 must be non-metallic so as to prevent any electrical shorting resulting from the support of the heater elements 56. If the hook members 60 were non-metallic, then the anchor rods could be fabricated from metallic material. In addition, if the anchor rod 58 was provided with electrical insulation on its surface, its core could be fabricated from a metallic material.

The three "PYRO-BLOC" modules are placed side-by-side across the width of the furnace 12 between dense insulation boards 76 and 78. Four ceramic anchor rods on three inch centers pass through the modules in a transverse direction to the furnace 12 and are anchored in boards 76 and 78. The anchor rods 58 are positioned approximately three inches from the lower surface of the fiber insulation 36. The heating elements 60 which extend in a longitudinal direction are placed on approximately two-inch centers.

It should be understood that the specific wall construction of the electric furnace as described herein, is presented for the purpose of explanation and illustration and is not intended to limit the invention, the scope of which is defined by the following claims.

I claim:

1. A furnace comprising:

opposing first and second sidewalls;

first and second structurally rigid insulating board attached to the interior of said furnace at said first and second sidewalls;

a roof;

roof insulating means;

at least one elongated rod passing through said roof insulating means and spanning the width of said furnace, said rod having a first and second end embedded within said first and second insulating board, respectively;

heating elements positioned within said furnace; and, means to support said heating elements from said rod.

2. A furnace as in claim 1 wherein said rod remains essentially undeflected when supporting said heating elements, and said first and second insulating means support the weight of said rod and said heating elements at said embedded ends of said rod.

3. A furnace as in claim 2 wherein said roof insulating means is lightweight, low inertia ceramic fiber insulation.

4. A furance as in claim 2 wherein said rod is a ceramic anchor rod.

5. A furnace as in claim 2 wherein said first and second ends of said rod are embedded within said first and second insulating means in spaced relation from said first and second sidewalls, respectively.

6. A furnace as in claim 2 wherein said support means includes S-shaped hooks wherein a first end of each of said hooks is removably engaged with said rod and an opposite end of each of said hooks is removably engaged with said heating elements.

7. A furnace as in claim 2 wherein said rod supports portions of at least two of said heating elements.

8. A heater support for positioning heating elements within the interior of a furnace having a roof, roof insulation, opposing sidewalls, and sidewall insulation, comprising:

an elongated rod passing through said roof insulation and spanning the width of said furnace, said rod having a first and second end embedded within said opposing sidewall insulation; and means to engage said heating elements with said rod.

9. A heater support as in claim 8 wherein said rod remains essentially undeflected when supporting said heating elements, and said insulated opposing sidewalls support the weight of said rod and said heating elements at said embedded ends of said rod.

10. A heater support as in claim 9 wherein said rod is a elongated ceramic anchor rod.

11. A heater support as in claim 9, wherein said engaging means includes S-shaped hooks wherein a first end of each of said hooks is removably engaged with said rod and an opposite end of each of said hooks is removably engaged with said heating elements.

12. Method of supporting a heating element in a furnace having a roof portion, roof insulating means, sidewalls, and sidewall insulating board comprising:

spanning the width of said furnace with at least one structurally rigid elongated rod, said rod passing through said roof insulating means;

embedding opposite ends of said rod in said sidewall insulating board;

engaging one end of a heating element support member with said rod;

engaging the opposite end of said heating element support member with said heating element; and supporting said rod at said embedded ends such that the weight of said rod and said heating elements is supported at end portions of said rod.

* * * * *